US005177496A

United States Patent [19]

Arimura et al.

[11] Patent Number: 5,177,496

[45] Date of Patent: Jan. 5, 1993

[54] FLAT SLOT ARRAY ANTENNA FOR TE MODE WAVE

[75] Inventors: Kunitaka Arimura; Akira Tsukada, both of Chigasaki; Fumio Takenaga, Kawasaki; Hiroshi Kasuga, Chigasaki, all of Japan

[73] Assignee: Arimura Giken Kabushiki Kaisha, Chigasaki, Japan

[21] Appl. No.: 512,294

[22] Filed: Apr. 20, 1990

[30] Foreign Application Priority Data

Apr. 28, 1989 [JP] Japan ..... 1-111169

[51] Int. Cl.[5] ..... H01Q 13/100

[52] U.S. Cl. ..... 343/771; 343/770

[58] Field of Search ..... 343/771, 770, 772, 767, 343/775, 776, 786

[56] References Cited

U.S. PATENT DOCUMENTS 2,479,209 8/1949 Chu ..... 343/771
2,807,800 9/1957 Broussaud ..... 343/771
3,311,917 3/1967 Thourel ..... 343/771
3,524,189 8/1970 Jones, Jr. ..... 343/771
3,599,216 8/1971 Paine ..... 343/771
3,990,079 11/1976 Epis ..... 343/771

FOREIGN PATENT DOCUMENTS 0067006 3/1989 Japan .
0067007 3/1989 Japan .

*Primary Examiner*—Rolf Hille
*Assistant Examiner*—Hoanganh Le
*Attorney, Agent, or Firm*—Schwartz & Weinrieb

[57] ABSTRACT

A pair of opposite metallic plates are disposed at an interval with respect to each other so as to form a wave guide space without side plates. A plurality of power radiating slots are formed within one of the metallic plates. A lens antenna is provided for forming a flat equiphase plane wave at the power feed opening of the wave guide space, so that the power is propagated within the wave guide space in the TE mode and radiated from the slots.

20 Claims, 16 Drawing Sheets

FLAT SLOT ARRAY ANTENNA FOR TE MODE WAVE

FIELD OF THE INVENTION

The present invention relates to a flat slot array antenna for a TE mode wave used within the communication, broadcasting and other fields.

BACKGROUND OF THE INVENTION

Referring to FIG. 19, slots b of the illustrated type of conventional slot array antenna for a radar system are formed within a side plate of the waveguide a. The electromagnetic waves fed to the waveguide a radiate from the slots. The ratio X:Y of the width X to the height Y of the waveguide is approximately 2:1.

Within a waveguide for a TE mode wave which requires a large gain, a plurality of waveguides are disposed in parallel with respect to each other.

However, in such a slot array antenna, the construction of the waveguide becomes complicated. Since the inner surface area of each waveguide increases, the propagation loss increases and the weight thereof also increases.

OBJECT OF THE INVENTION

The object of the present invention is to provide a flat slot array antenna within which a waveguide for the TE mode wave is simple in construction and the antenna gain is increased.

SUMMARY OF THE INVENTION

According to the present invention, there is provided a flat slot array antenna for a TE mode wave comprising a pair of opposite metallic plates disposed parallel to each other with a predetermined distance therebetween so as to define a wave guide space having a power feed opening, each plate having a substantially rectangular shape, one of the metallic plates having a plurality of power radiating slots arranged in a plurality of longitudinally extending and laterally spaced rows, each row forming a broadside array, and power feeder means for forming a flat equiphase plane wave at the power feed opening, whereby power fed by the power feeder means is propagated within the wave guide space in the TE mode and is radiated from the slots.

In accordance with one aspect of the present invention, the antenna further comprises spacers provided between the metallic plates.

A spacer may be provided within the wave guide space so as to occupy the entire wave guide space.

In accordance with another aspect, the antenna further comprises a slow-wave means disposed within the wave guide space.

The width of the metallic plate may be within the range of between 10 times and 80 times as large as the wavelength of the TE mode wave and the length of the plate may be within the range of between 10 times and 60 times as large as the wavelength of the TE mode wave.

Within the antenna of the present invention, the TE mode wave is fed into the wave guide space formed by means of a pair of metallic plates. The TE mode wave is propagated in the foward direction without changing the mode while exciting the metallic plates which are disposed perpendicular to the electric field, and is radiated from the slots.

BRIEF DESCRIPTION OF THE DRAWINGS

These and other objects and features of the present invention will become more apparent from the following detailed description with reference to the accompanying drawings, in which like reference characters designate like or corresponding parts throughout the several views, and wherein.

DETAILED DESCRIPTION OF THE PREFERRED EMBODIMENTS

Figure 1:
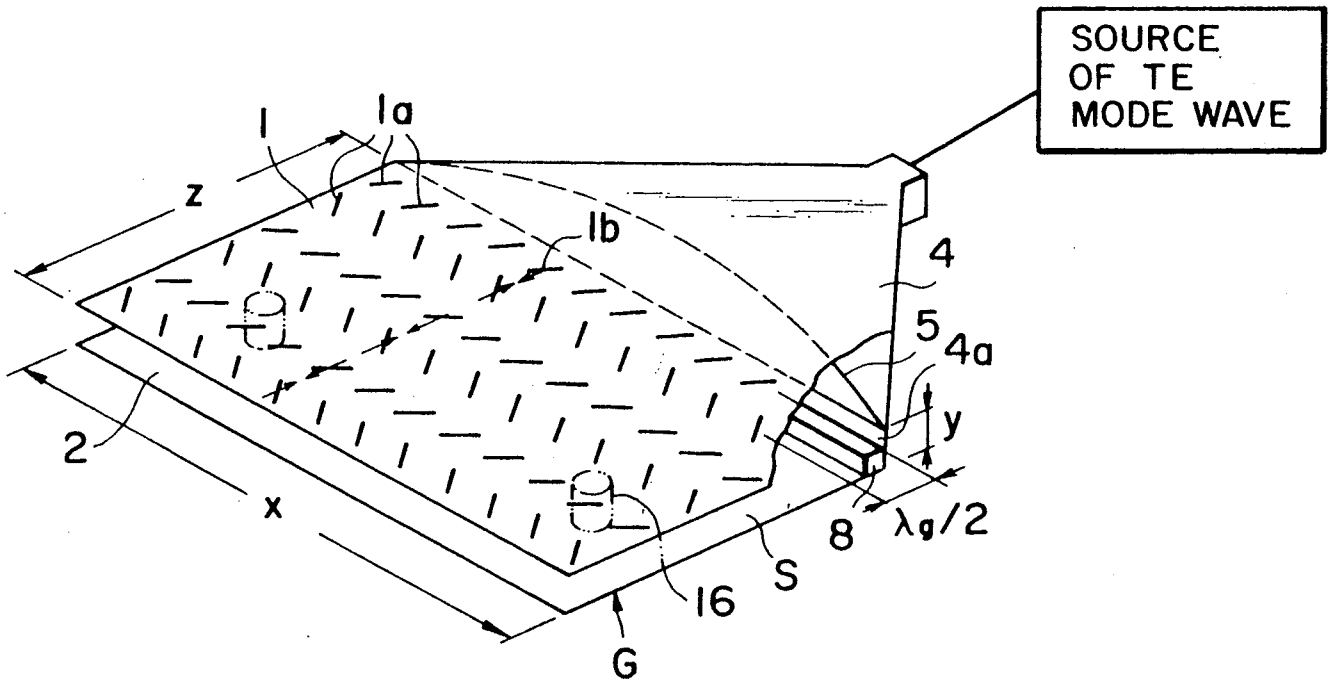
FIG. 1 is a perspective view showing a flat slot array antenna for a TE mode wave according to the present invention.
Figure 7:
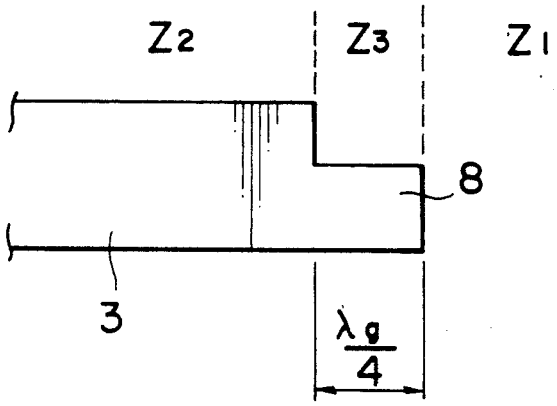
FIG. 7 is a sectional view of a matching portion provided within the fourth embodiment.

Referring to FIG. 1 showing a first embodiment of the present invention, a flat slot array antenna for a TE mode wave according to the present invention comprises a rectangular wave guide member G having a power feed opening 4*a* formed at an inlet side thereof, and an H-plane horn 4 connected to the wave guide member G at the power feed opening 4*a*. The horn has a horn-like shape in an H-plane. The wave guide member G comprises oppositely disposed rectangular metallic plates 1 and 2, separated from each other by means of a predetermined amount so as, to form a wave guide space S therebetween. Side plates to be normally secured to the three sides of each plate 1 and 2 are obviated in accordance with the present invention. A lens antenna 5 of a dielectric material is provided at the power feed opening 4*a*. The lens antenna 5 has a matching portion 8 integrally formed therewith within the vicinity of the power feed opening 4*a* such that the antenna 5 has a stepwise form wherein portion 8 has a length of approximately λg/4 as shown in FIG. 7.

The metallic plate 1 disposed within the H-plane has a plurality of electrical power radiation slots 1*a*, arranged in a plurality of longitudinally extending laterally spaced rows. The slots 1*a* within each longitudinal row are formed at intervals of one-half wavelength λg/2 and at 45 degrees with respect to the axis of the waveguide. Thus, each row forms a broadside array. Slots 1*a* disposed within adjacent rows are inverted so as to be disposed at 90 degrees with respect to each other.

The width X of the wave guide member is larger than one-half of the wavelength λ within free space. In the present embodiment, the width X is more than 10λ and the length Z is also more than 10λ. The ranges of the width X and the length Z for the TE mode are within the approximate ranges of λ/2 and 300λ and between λ and 300λ, respectively. For antennas receiving satellite broadcasting waves at home and for commercial use at broadcasting stations, the width X is preferably between 10λ and 80λ and the length Z is preferably between 10λ and 60λ.

In the first embodiment of the present invention, the phase difference which occurs within the H-plane horn 4 is compensated for by means of the lens antenna 5 so as to form a flat equiphase plane wave at the power feed opening 4*a*, which is like a plane wave and which generates a Poynting power P. Thus, the wave is fed into the wave guide member G and propagated within the wave guide space S, thereby maintaining the wave form.

An explanation will now be made with respect to the wave propagation within the waveguide space. Referring to FIG. 2*b* showing a conventional waveguide having a pair of side plates 7 so as to form a wall around the wave guide space, the $TE_{10}$ mode wave propagates forward by the inertia of the electromagnetic wave without changing its mode. Within the antenna of the present invention shown in FIG. 2*c* wherein the side wall has been eliminated the $TE_{10}$ mode wave is propagated in the forward direction without changing its mode in the same manner as with the conventional waveguide while exciting the two upper and lower metal plates which are disposed perpendicular to the electrical field. Namely, the electromagnetic field which heretofore has been believed to be a waveguide mode wave can be propagated between the two plates. Therefore, the leakage of the useful wave from the sides of the wave guide space as is experienced in connection with a travelling within TEM mode wave a parallel-plate waveguide as shown in FIG. 2*a*, does not occur.

In the figures, reference E designates the electrical lines of force and M designates the magnetic lines of force.

Figure 2A:
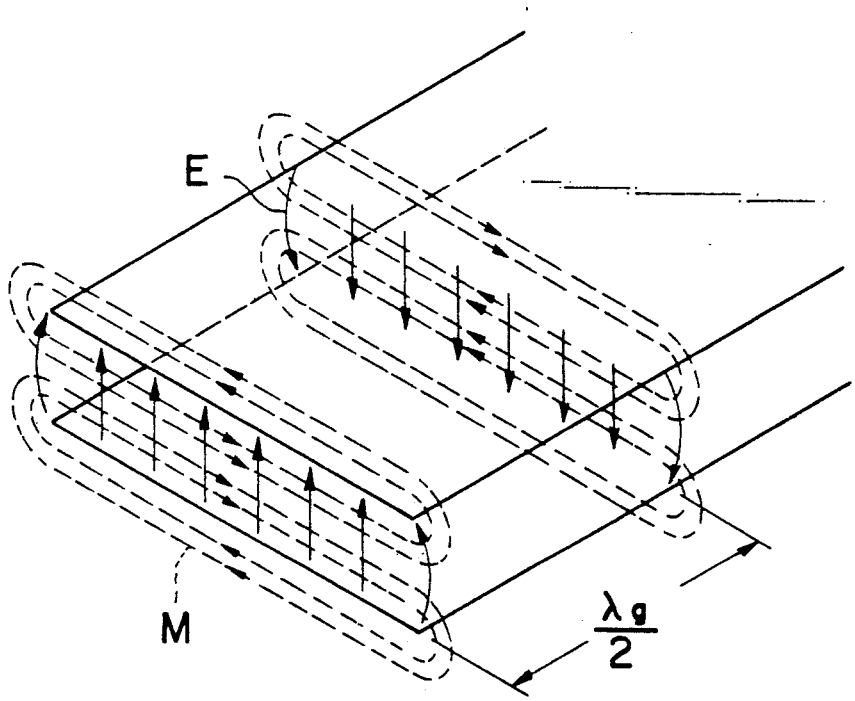
FIG. 2a PRIOR ART
FIGS. 2*a* to 2*c* are illustrations explaining wave propagation modes within the conventional slot array antenna and within the slot array antenna of the present invention.
Figure 2B:
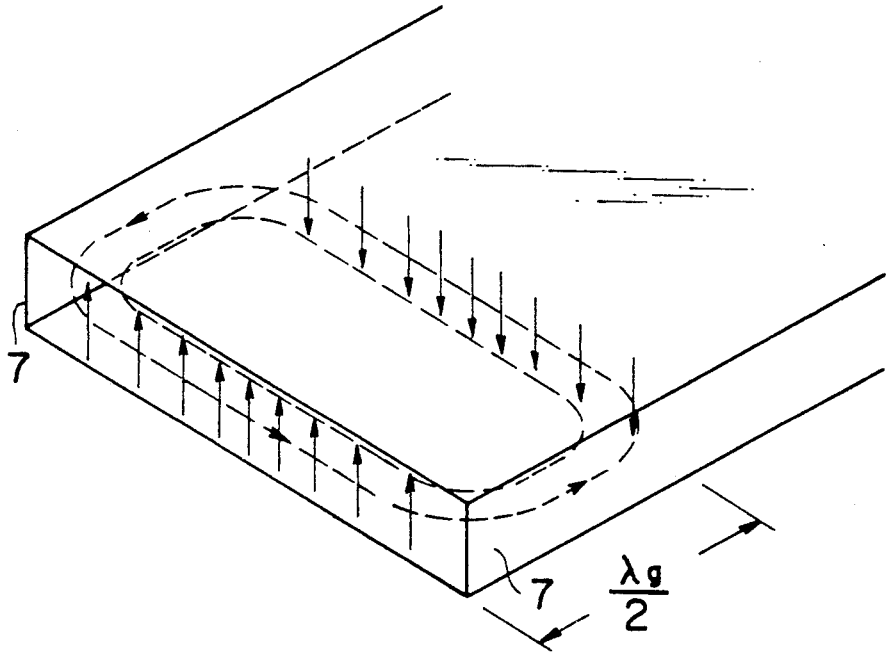
FIG. 2b PRIOR ART
Figure 2C:
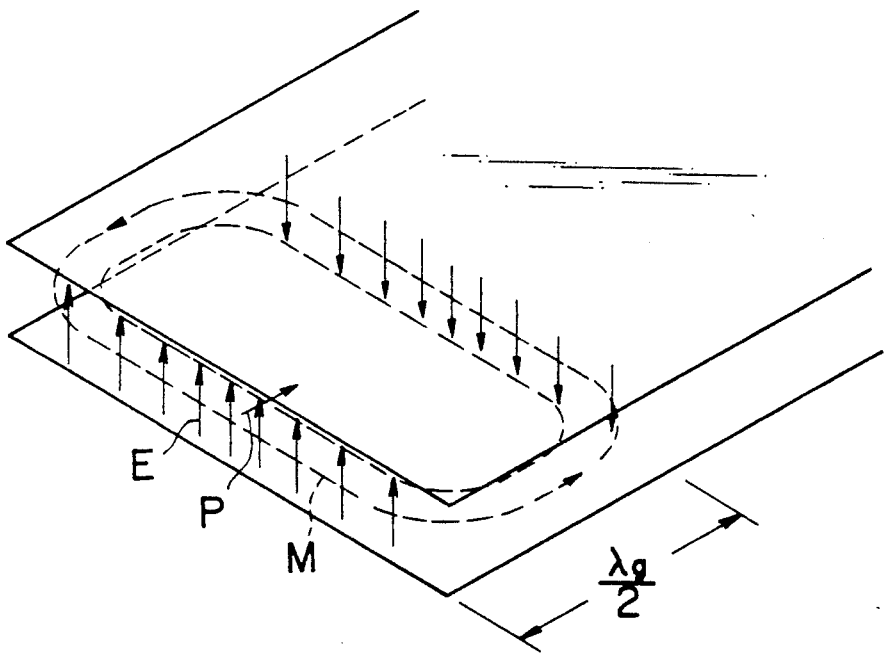

FIGS. 2*a*, 2*b* and 2*c* are only schematic illustrations for explaining the wave modes and each actual wave guide is of an extremely thin construction having a ratio of the width X to the height Y of approximately 100:1.

As the $TE_{10}$ mode wave propagates, surface current 1*b* flows in the propagating direction as shown in FIG. 1 so that the wave radiates from the slots 1*a* arranged in a direction intersecting the surface current 1*b*. Since the width X of the antenna is large in the present embodiment, the wavelength λg in the wave guide space S substantially equals the wavelength λ in the free space. Moreover, the slots 1*a* are arranged at a distance of λg/2. Accordingly, the grating lobe can be suppressed. The slots 1*a* are arranged at a distance of λg/2 so as to radiate the power in an equiphase manner. As a result, the main beam becomes substantially perpendicular to the radiation plane. However, the beam tilt can be arbitrarily controlled by changing the distance defined between the slots 1*a*.

In the present embodiment, since the width X of the plates 1 and 2 is sufficiently longer than the length Z of the plates 1 and 2, the plates 1 and 2 can be made integral with the H-plane horn 4 without employing any spacer between the plates. As a result, the weight of the antenna can be remarkably reduced.

However, as shown in FIG. 1, an appropriate number of insulation posts 16 shown by means of dot-dash lines may be provided at appropriate positions so as to maintain the relative spacing or separation distance defined between plates 1 and 2.

Figure 3:
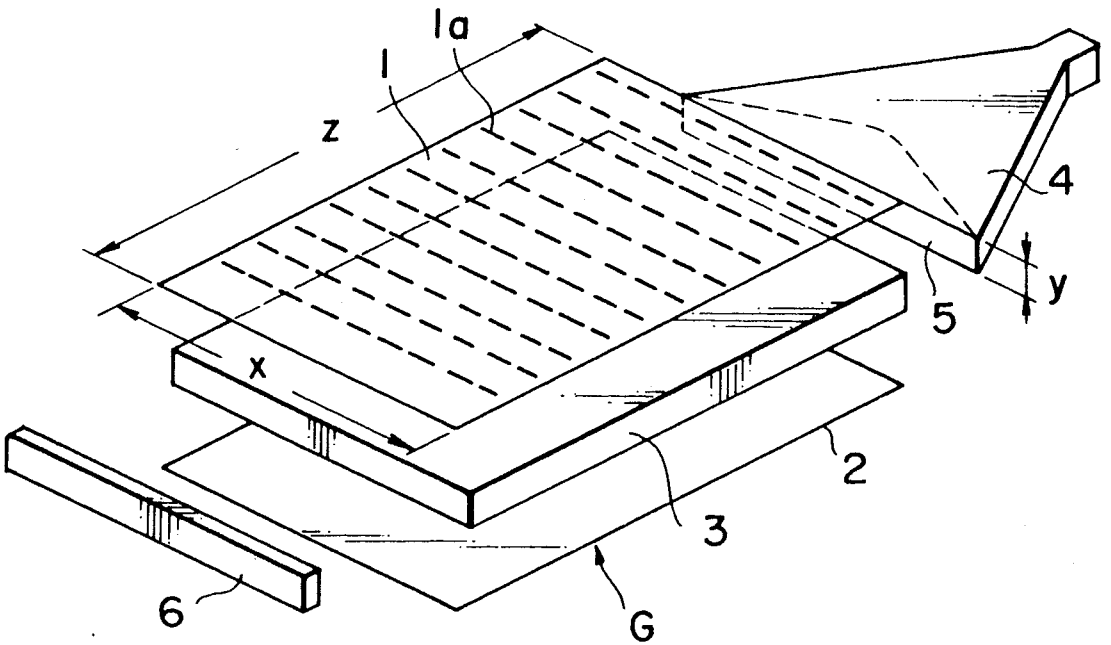
FIG. 3 is an exploded perspective view showing a flat slow array antenna for a TE mode wave constructed in accordance with a second embodiment of the present invention.
Figure 4:
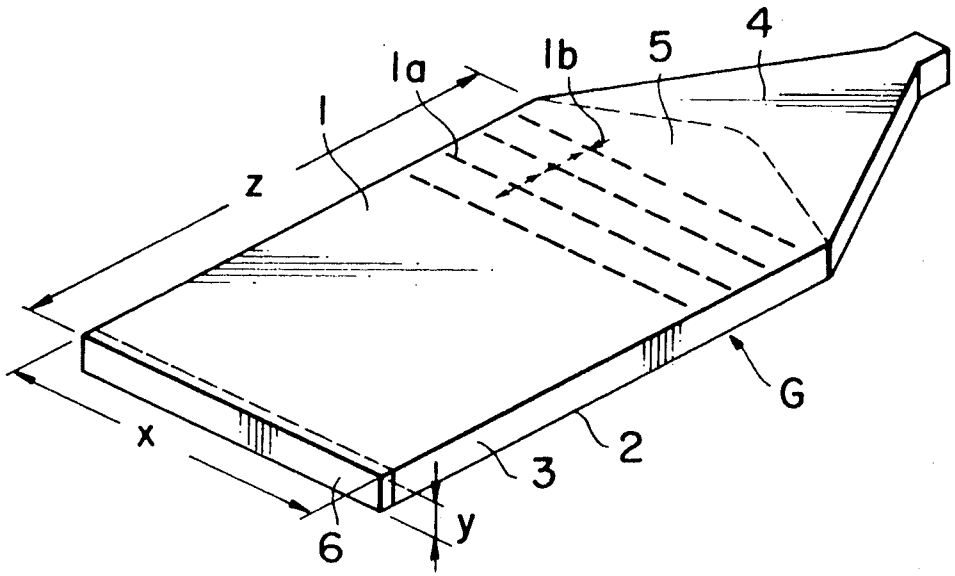
FIG. 4 is a perspective view showing the assembled flat slow array antenna of the second embodiment.

Referring now to FIGS. 3 and 4, the wave guide member G of the second embodiment has a dielectric member 3, fabricated from polyethylene foam and which also serves as a spacer, interposed between the metal plates 1 and 2. A plurality of slots 1*a* each having a length of one-half of the wavelength are laterally arranged at a distance of the wavelength λg. A terminal resister 6 is provided at the terminal end of the wave guide member G opposite the H-plane horn 4. The phase difference is compensated by means of the lens antenna 5 so as to form a plane wave. The surface current flows within the plate 1 so as to radiate the wave from the slots 1*a*.

The slots 1*a* of the present embodiment are arranged at a distance of λg so as to radiate the waves in an equiphase manner. In order to reduce the grating lobe, the dielectric 3 is provided within the waveguide space, so that the wavelength λg becomes smaller than or equal to 0.95λ (λg≦0.95λ), and is actually between 0.6λ and 0.95λ. Therefore, the main beam becomes perpendicular to the radiation plane. The distance defined between the slots 1*a* is changed so as to control the beam tilt. Remaining power within the wave guide member G is absorbed by means of the terminal resistor 6, thereby preventing unwanted influence or interference from any reflected power. Other constructions and operations are the same as those of the first embodiment.

Figure 5:
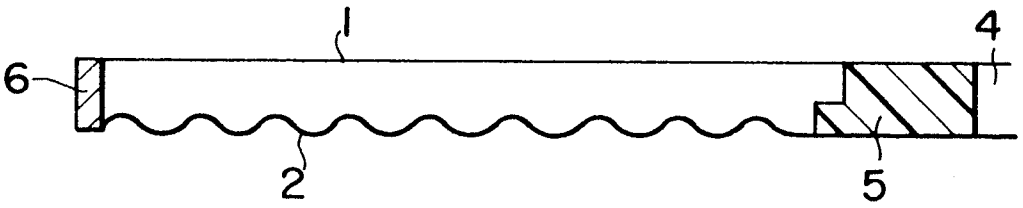
FIG. 5 is a sectional view showing a modification of the antenna of FIG. 4 and thereby comprising a third embodiment of the present invention.

If the dielectric 3 is not provided within the wave guide member G having slots 1*a* laterally arranged in accordance with the second embodiment, the wavelength λg for determining the distance between the slots becomes substantially equal to λ in free space. In order to reduce the grating lobe, the lower metal plate 2 is corrugated so as to form a slow-wave device as shown in FIG. 5. Alternately, a radome of dielectric material may be provided upon the free space side of the metal plate 1 as a slow-wave device.

If all power is radiated from the slots, the terminal resistor 6 is omitted, thereby increasing the antenna efficiency.

As shown in FIG. 4, if the dielectric lens antenna 5 and the dielectric member 3 interposed between the plates 1 and 2 are internally formed together, or if the upper and the lower plates of the H-plane horn 4 are integral with the metal plates 1 and 2, respectively, the manufacturing cost can be reduced.

Figure 6:
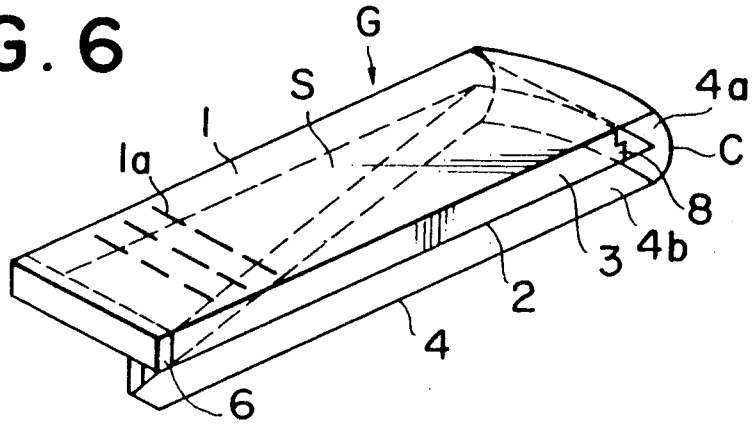
FIG. 6 is a sectional perspective view showing a fourth embodiment of a flat slot array antenna constructed in accordance with the present invention.
Figure 8:
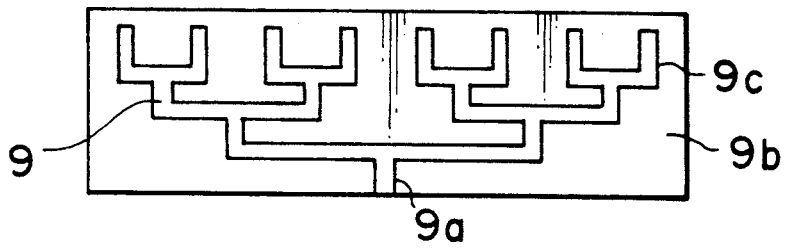
FIGS. 8 and 9 are front views showing different types of power feeder means for use within fifth and sixth embodiments of the present invention.

In accordance with the antenna shown in FIG. 6 as a fourth embodiment of the present invention, the wave guide member G is superimposed upon the H-plane horn 4 so as to form a compact construction. The plate 2 is shortened so that the opening 4*b* of the horn 4 is connected to the opening 4*a* of the wave guide member G by means of a U-shaped connection. The antenna has a parabolic reflector C within the region of the U-shaped connection and the stepwise matching portion 8 provided upon the power feeding side of the dielectric member 3 as shown in FIGS. 7 and 8. The length of the matching portion is approximately $\lambda g/4$. By reflecting the wave by means of the parabolic reflector C, the phase difference is compensated to form a flat equiphase wave plane without a lens antenna. Thus, slots 1*a* can be disposed in a parallel array.

The characteristic impedance $z_3$ of the matching portion 8 is adjusted so as to satisfy the following equation: $z_3=\sqrt{z_1 \cdot z_2}$, wherein $z_1$ and $z_2$ are the characteristic impedances of the horn 4 and the wave guide space S, respectively. Thus the impedances are matched thereby obviating reflections at the inlet of the wave guide member G. The operation and effect of the embodiment are the same as those of the second embodiment.

Figure 9:
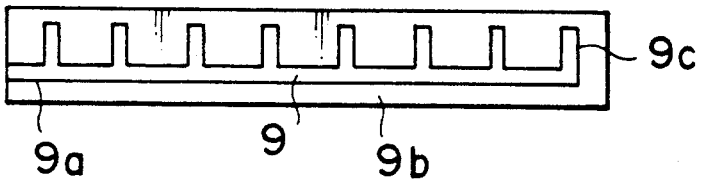
Figure 10:
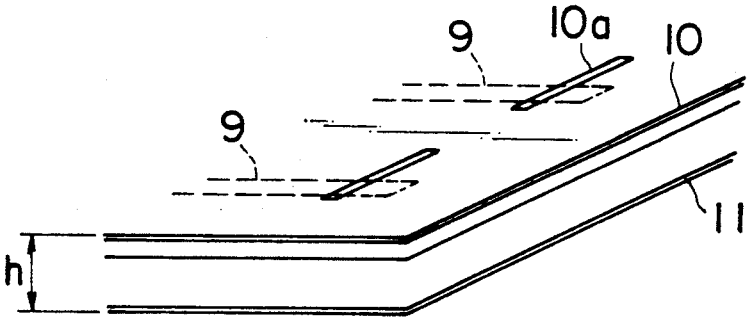
FIG. 10 is a perspective view of one of the power feeder means of FIGS. 8 and 9.

FIGS. 8 and 9 show a power feeder means for a fifth embodiment of the present invention, respectively. Each power feeder means is a microstrip line comprising a substrate 9*b* of dielectric material, a branching strip 9 in intimate contact with one side of the substrate 9*b* and a grounding plate 10 (FIG. 10) provided upon the other side of the substrate. The strip 9 has a feeding end 9*a*. As shown in FIG. 10, the grounding plate 10 has a plurality of radiating slots 10*a*, each being disposed opposite to a feeder end 9*c* of the strip 9. A reflector plate 11 is disposed opposite the grounding plate 10 with a space defined therebetween through means of spacers (not shown). Distance h defined between the reflector plate 11 and the grounding plate 10 is approximately $\lambda/4$ so that the power radiates from the slots 10*a* in a predetermined direction.

Figure 11:
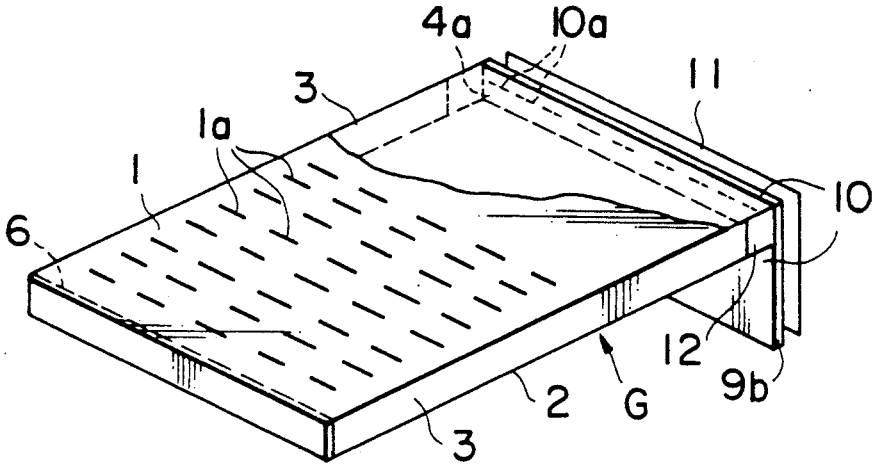
FIG. 11 is a perspective view showing an antenna provided with the power feeder means of either FIGS. 8 or 9 so as to comprise a seventh embodiment of the present invention.
Figure 12:
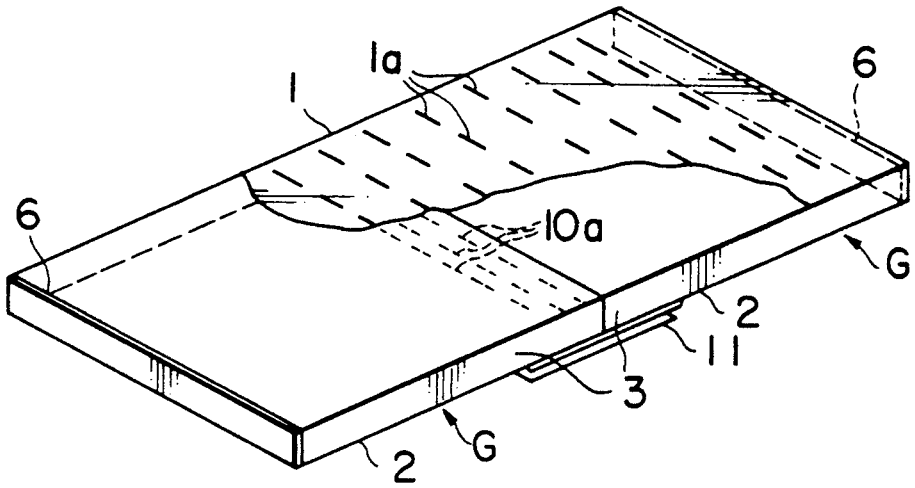
FIG. 12 is a perspective view showing an antenna utilizing the power feeder means of either FIG. 8 or FIG. 9 and comprising an eighth embodiment of the present invention.

FIGS. 11 and 12 show antennas provided with the power feeder means shown in FIG. 8 or FIG. 9. The feeder means is attached to the antenna so as to dispose the slots 10*a* toward the power feed opening 4*a* of the wave guide member G. The antenna of FIG. 12 comprises a pair of adjacent wave guide members G. The power feeder means consisting of a pair of microstrip lines is accordingly attached to a central portion of the antenna. The construction of the wave guide member G is the same as that within the second embodiment of the present invention.

Figure 13:
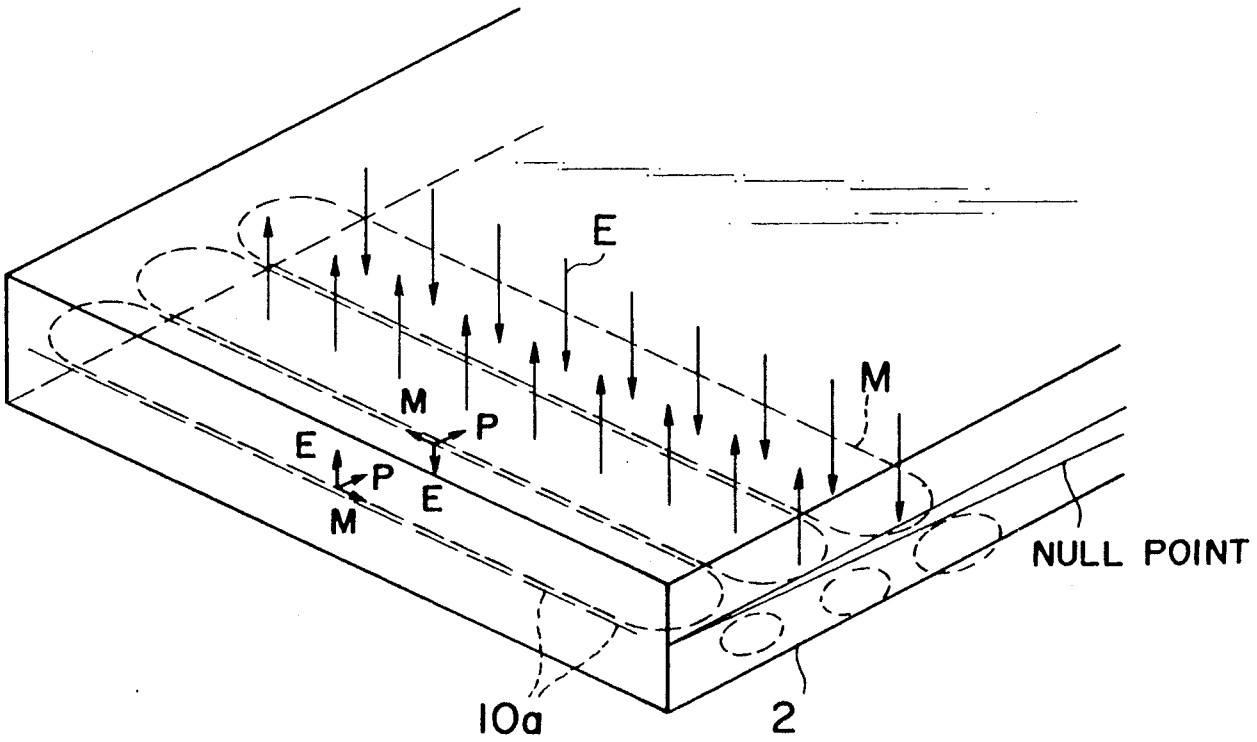
FIG. 13 is an illustration explaining wave propagation modes within the antenna.

Thus, in accordance with the power feeder means of FIGS. 8 and 9 which constitute fifth and sixth embodiments of the present invention, the distribution of power in the lateral direction may be rendered uniform as shown in FIG. 13, thereby increasing the efficiency of the antenna.

In the foregoing mode, the wave becomes a plane wave at a distance. Since the null point of the main lobe is defined at a position where the phase changes and where the side lobe is generated in the same form, the main power is propagated at least within the width of the null point. For example, when a first null angle is 3°, the power is radiated within the amplitude of 3°. If the half-power beam-width is ±1.5°, a metal plate 1 or 2 having a side edge diverging toward the terminal end at an angle of 1.5° may be provided. However, since the propagation distance is short, the widths of the opening 4*a* of the power feed means 4 and the waveguide need not be changed substantially.

On the other hand, in order to prevent the leakage of waves from the power feed opening 4*a* and in order to shape the beam, a pair of wave guide plates 12 are provided within the wave guide member G at a position adjacent the power feed opening 4*a*. Thus, the electromagnetic waves which leak or radiate from the slots 10*a* are linearly propagated, thereby reducing the leakage from the sides of the wave guide member G.

Figure 14A:
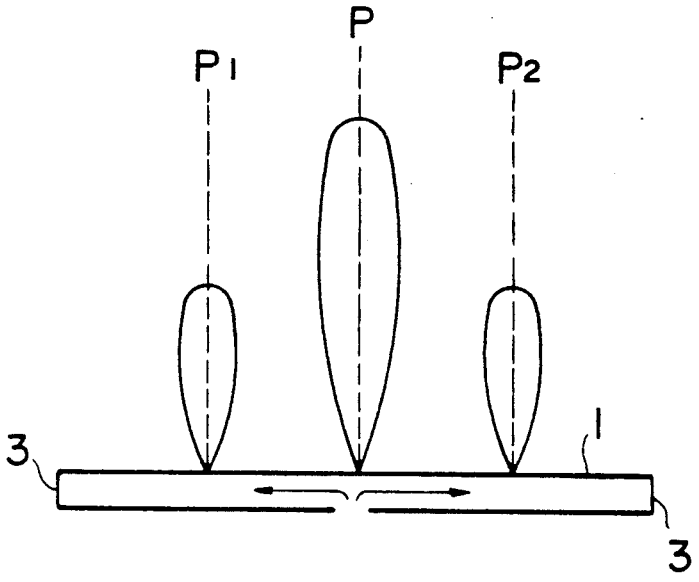
FIGS. 14*a* and 14*b* are illustrations showing the directivity of the antenna.
Figure 14B:
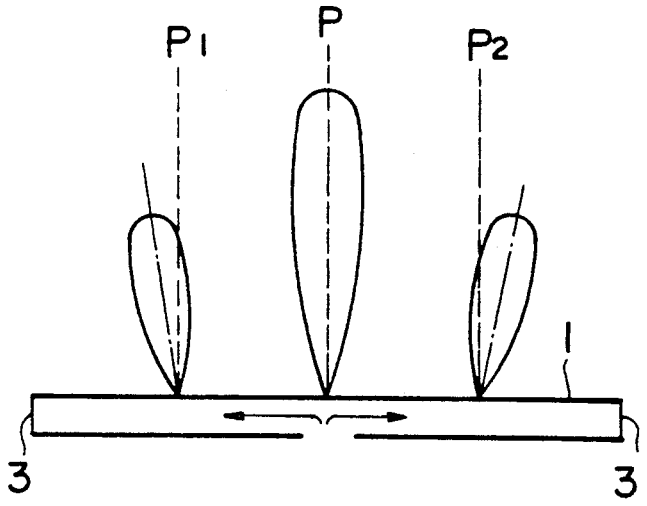

FIGS. 14*a* and 14*b* show the directivity of the antenna of the eighth embodiment of the present invention shown in FIG. 12. The power fed from the power feeder means is divided into the right and left wave guide members G. The divided powers propagate symmetrically in the right and left directions. Therefore, if the wavelength of the power changes, the left main lobe P1 and the right main lobe P2 incline symmetrically as shown in FIG. 14*b*. Consequently, the direction of the resultant main lobe P advantageously becomes perpendicular to the surface of the antenna. Other structural features of this embodiment are the same as those of the second embodiment.

Figure 15:
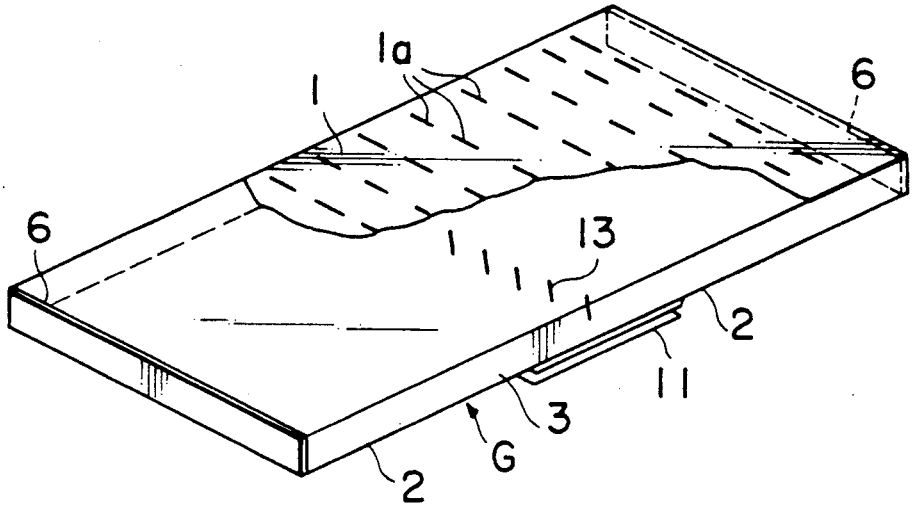
FIG. 15 is a perspective view showing a ninth embodiment of the present invention.

FIG. 15 shows the ninth embodiment of the present invention also having a power feeder means in the form of a microstrip line. The branching strip 9 is connected to a plurality of exciting poles 13 arranged in the lateral direction with respect to the wave guide member G. The operation and effect of this embodiment are the same as those of fifth and sixth embodiments.

Figure 16:
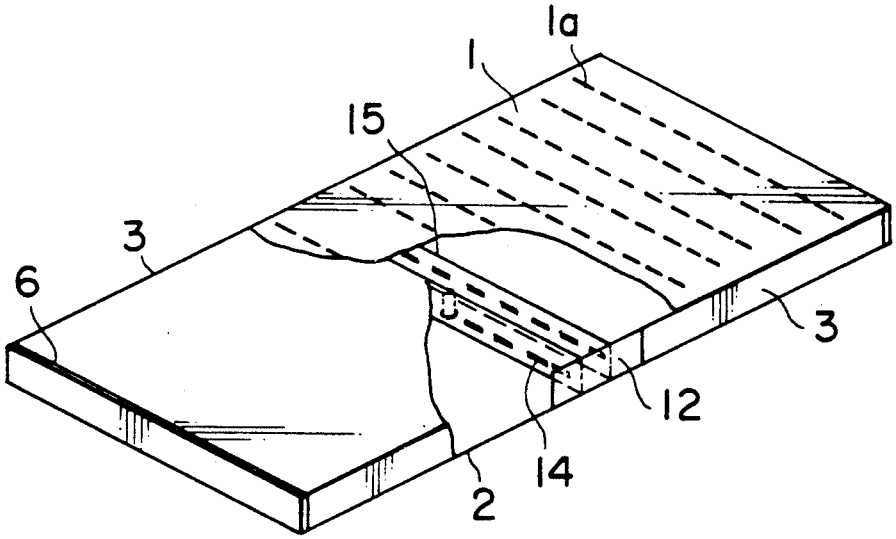
FIG. 16 is a perspective view showing a tenth embodiment of the present invention.

The tenth embodiment of the present invention as shown in FIG. 16 has a laterally disposed rectangular waveguide 15 having a plurality of openings 14 upon both sides thereof. The distribution and size of the openings 14 are so designed as to leak or radiate the equiphase power at equal amplitudes. The other structural features, operation and effect of this embodiment are the same as those of the ninth of the present invention embodiment.

Figure 17:
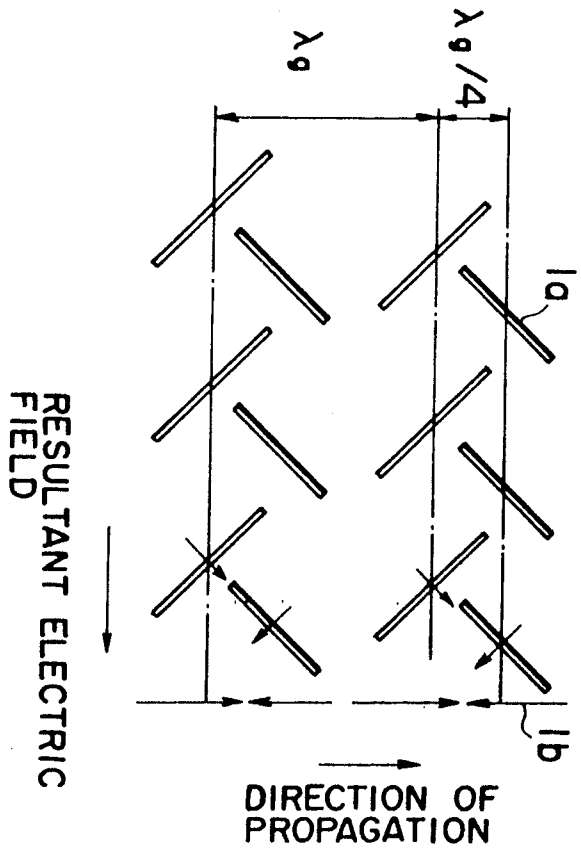
FIGS. 17 and 18 show arrangements of electrical power radiation slots of the antenna.
Figure 18:
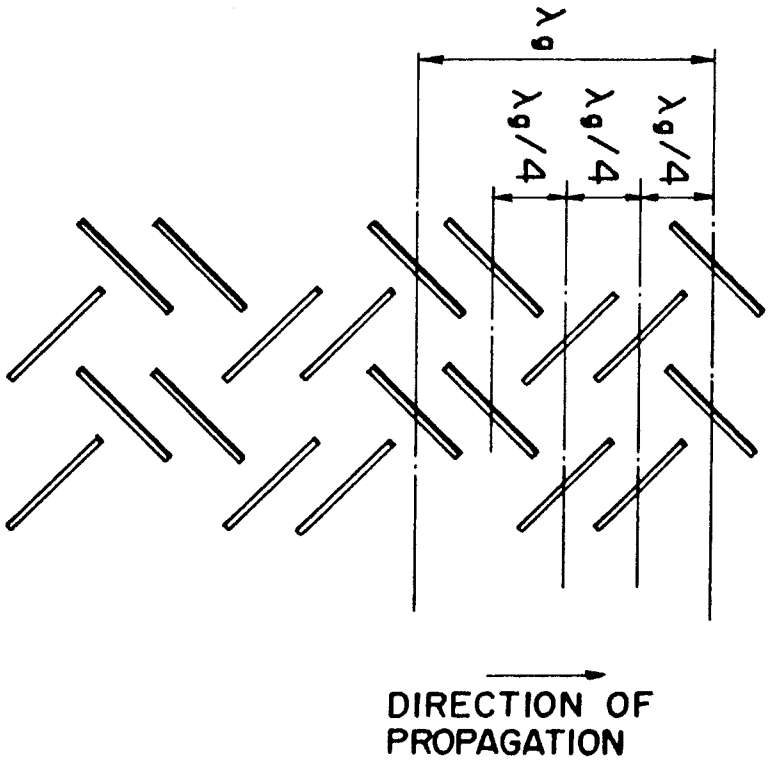
Figure 19:
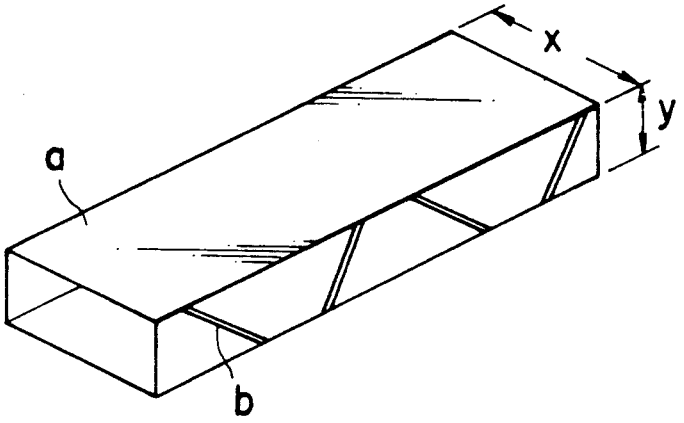
FIG. 19 PRIOR ART
FIG. 19 is a perspective view showing a conventional slot array antenna.

FIGS. 17 and 18 show other arrangements of the slots 1*a* which may be employed within the waveguides and antennas of the present invention. The slots within a particular row as illustrated within FIG. 17 are arranged at the distance of $\lambda g/4$ with respect to each other. The direction of a particular slot 1*a* is perpendicular to that of an adjacent slot 1*a* disposed within the same row. The resultant electrical field of the waves radiated from the pair of slots rotates in the counterclockwise direction and becomes a circularly polarized wave. The pairs of slots are arranged within rows which are separated from each other by means of a distance $\lambda g$ so as to propagate an equiphase wave within each row.

Another slot array antenna is shown in FIG. 18 for radiating linearly polarized waves. The left and right polarized waves which are out of phase with respect to each other are generated so that the resultant wave becomes a linearly polarization wave.

From the foregoing, it will be understood that the present invention provides a flat antenna for a TE mode wave having a wave guide member comprising upper and lower metal plates where the side plates between the upper and lower plates which were believed to be indispensable are in fact eliminated. One of the plates, which has a plurality of slots for radiating the power, and the other plate are maintained at a distance with respect to each other by means made of a light material so that the power in the form of the TE mode wave is effectively propagated, thereby increasing the antenna gain. Since the construction of the antenna is simplified, the manufacturing cost and the weight thereof are substantially reduced.

While the invention has been described in conjunction with preferred specific embodiments thereof, it will be understood that this description is intended to illustrate and not limit the scope of the invention, which is defined by the following claims. Accordingly, within the scope of the appended claims, the present invention may be practiced otherwise than as specifically described herein.

What is claimed is:

1. A flat slot array antenna for propagating a TE mode wave, comprising:

a pair of oppositely disposed metallic plates spaced apart with respect to each other by means of a predetermined distance therebetween so as to form a waveguide space having open sides and a power feed opening defined within one end thereof, each of said plates having a substantially rectangular shape so as to define a rectangular waveguide, and wherein one of said metallic plates has a plurality of power radiating slots defined therein and arranged within a plurality of longitudinally extending and laterally spaced rows; and power feeder means connected to said rectangular waveguide at said power feed opening thereof and comprising a source means for feeding a TE mode wave in a continuous wave mode, the electrical and magnetic fields of which intersect each other perpendicularly within mutually orthogonal planes such that said electrical field is disposed perpendicular to said pair of oppositely disposed metallic plates of said rectangular waveguide while said magnetic field is disposed parallel to said pair of oppositely disposed rectangular metallic plates of said rectangular waveguide, toward said rectangular waveguide such that said TE mode wave propagates with the phase fronts thereof being coaxial, and means for converting each one of said coaxial phase fronts of said TE mode wave into a flat equiphase plane wave at said power feed opening of said waveguide space such that the power fed by said power feeder means is propagated within said waveguide space in said TE mode with said electrical field of each wave being disposed within a flat plane so as to be radiated from said slots of said one of said pair of metallic plates.

2. The antenna according to claim 1 further comprising spacers provided between the metallic plates.

3. The antenna according to claim 1 further comprising a spacer provided between the metallic plates so as to occupy the entire wave guide space.

4. An antenna as set forth in claim 3, wherein:

said spacer comprises foam polyethylene.

5. The antenna according to claim 1 further comprising a slow-wave means disposed within said wave guide space between said pair of metallic plates.

6. The antenna according to claim 1 wherein the width of each metallic plate is within a range of between 10 times and 80 times as large as the wavelength of the TE mode wave and the length of each plate is within a range of between 10 times and 60 times as large as the wavelength.

7. The antenna according to claim 1 wherein the converting means includes a lens antenna.

8. An antenna as set forth in claim 7, wherein:

the width of said lens antenna is substantially equal to the width of said power feed opening and said waveguide space of said rectangular waveguide.

9. The antenna according to claim 1 wherein the converting means includes a parabolic reflector.

10. An antenna as set forth in claim 1, wherein said power feeder means comprises:

a horn waveguide connected to said rectangular waveguide at said power feed opening of said rectangular waveguide.

11. An antenna as set forth in claim 10, wherein:

said rectangular waveguide is disposed atop said horn waveguide.

12. An antenna as set forth in claim 11, wherein:

said rectangular waveguide is connected to said horn waveguide by means of a substantially U-shaped connection; and a parabolic reflector is disposed within said U-shaped connection.

13. An antenna as set forth in claim 10, wherein said converting means comprises:

a dielectric lens antenna disposed within said horn waveguide.

14. An antenna as set forth in claim 13, wherein:

said lens antenna comprises a stepped matching portion disposed toward said power feed opening.

15. An antenna as set forth in claim 13, wherein:

the width of said lens antenna is substantially equal to the width of said power feed opening and said waveguide space of said rectangular waveguide.

16. An antenna as set forth in claim 1, wherein:

said slots disposed within each of said longitudinally extending rows are disposed at an angle of 45° with respect to a longitudinal axis of said rectangular waveguide.

17. An antenna as set forth in claim 16, wherein:

said slots disposed within adjacent longitudinally extending rows are disposed at 90° with respect to each other.

18. An antenna set forth in claim 1, further comprising:

a terminal resistor disposed at a terminal end of said rectangular waveguide which is opposite said power feed opening end of said rectangular waveguide.

19. An antenna as set forth in claim 1, wherein:

said other one of said pair of metallic plates comprises a corrugated slow-wave device.

20. An antenna as set forth in claim 1, wherein:

said rectangular waveguide is connected to another rectangular waveguide in a co-planar mode.

* * * * *